US008899337B2

(12) United States Patent
Surjaatmadja et al.

(10) Patent No.: US 8,899,337 B2
(45) Date of Patent: Dec. 2, 2014

(54) METHOD AND APPARATUS FOR SECURING AND USING HYRDAJETTING TOOLS

(75) Inventors: Jim Basuki Surjaatmadja, Duncan, OK (US); Dustin Holden, Duncan, OK (US); Desmond Jones, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 118 days.

(21) Appl. No.: 13/608,637

(22) Filed: Sep. 10, 2012

(65) Prior Publication Data

US 2014/0069634 A1 Mar. 13, 2014

(51) Int. Cl.
*E21B 23/01* (2006.01)
*E21B 33/128* (2006.01)

(52) U.S. Cl.
USPC ..... 166/382; 166/240; 166/118; 166/133; 166/222

(58) Field of Classification Search
USPC ..... 166/222, 223, 298, 305.1, 307, 237, 166/240, 382, 133, 142, 146, 118
See application file for complete search history.

(56) References Cited

U.S. PATENT DOCUMENTS

| | | | |
|---|---|---|---|
| 2009/0133876 | A1 | 5/2009 | Surjaatmadja et al. |
| 2010/0218993 | A1 | 9/2010 | Wideman et al. |
| 2011/0162843 | A1 | 7/2011 | Maier et al. |
| 2011/0198082 | A1 | 8/2011 | Stromquist et al. |
| 2012/0090847 | A1 | 4/2012 | Getzlaf et al. |

OTHER PUBLICATIONS

International Search Report and Written Opinion in PCT/US2013/057827, mailed Nov. 27, 2013, 11 pages.

*Primary Examiner* — Robert E Fuller
(74) *Attorney, Agent, or Firm* — Anthony P. Iannitelli; Baker Botts L.L.P.

(57) ABSTRACT

An apparatus for securing and using hydrajetting tools within a borehole includes a housing that defines an inner bore. A flow limiting member may be disposed within the inner bore. The flow limiting member may include a first a first jet in fluid communication with the top of the housing, a first chamber positioned below and in fluid communication with the first jet, and a first cavity aligned with the first jet and in fluid communication with the chamber. A groove may be disposed on an outer surface of the housing, with an anchor assembly that is disposed around the housing and axially slidable and securable within the groove.

17 Claims, 4 Drawing Sheets

METHOD AND APPARATUS FOR SECURING AND USING HYRDAJETTING TOOLS

BACKGROUND

Figure 1:
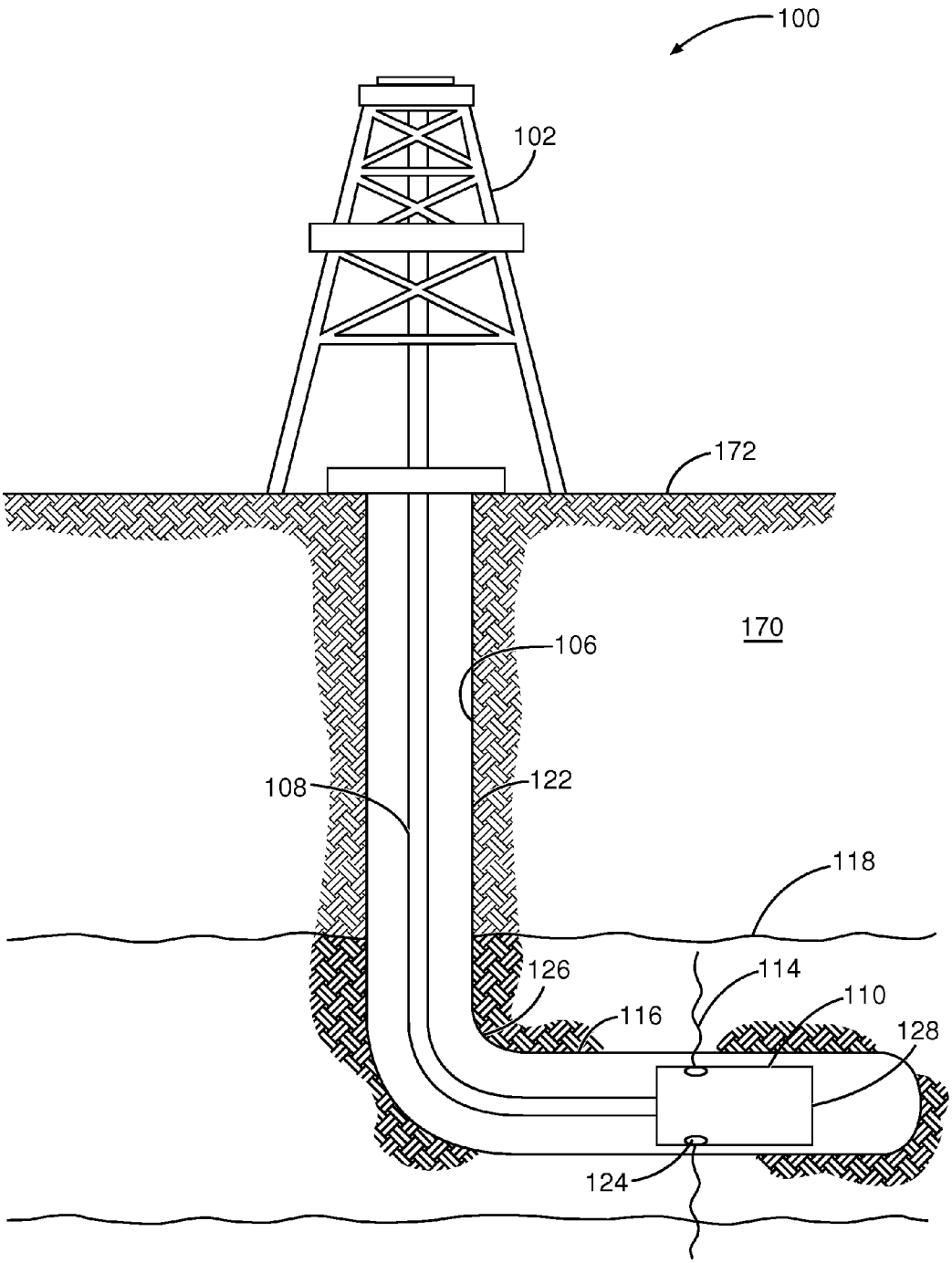

The present disclosure relates generally to subterranean drilling operations and, more particularly, the present disclosure relates to a method and apparatus for securing and using hydrajetting tools.

Subterranean drilling operations typically include piercing a subterranean formation in order to release hydrocarbons (e.g., oil, gas, etc.) from the formation for retrieval at the surface. In some instances, after the borehole reaches the formation, or a pre-determined depth within the formation, the formation may be stimulated using well known procedures in the art. These procedures may be used to increase the production of hydrocarbons from the formation, and may include hydraulic fracturing, acidizing, and hydrajetting. Hydrajetting, for example, may use a focused or pinpointed stimulation operation, which stimulates narrow bands of the formation while limiting damage to surrounding areas. Unfortunately, hydrajetting tools may be difficult to secure when downhole, causing movement in the hydrajetting tool that may decrease the accuracy and effectiveness of the tool. After one zone of the formation has been stimulated with the hydrajetting tool, it may be necessary to plug that zone while the next zone is stimulated. Sand plugs may be used to isolate the stimulated zones, but placing the sand plugs can require a low flow rate that is difficult to maintain downhole. Existing approaches to restrict the flow are difficult to control and manufacture, and may become clogged as a result of setting the sand plug.

BRIEF SUMMARY OF THE INVENTION

The present disclosure relates generally to subterranean drilling operations and, more particularly, the present disclosure relates to a method and apparatus for securing and using hydrajetting tools.

In certain embodiments, the present disclosure is directed to an apparatus for securing and using hydrajetting tools within a borehole. The apparatus comprises a housing which defines an inner bore. A flow limiting member is disposed within the inner bore. The flow limiting member comprises a first jet in fluid communication with the top of the housing, a first chamber positioned below and in fluid communication with the first jet, and a first cavity aligned with the first jet and in fluid communication with the chamber. A groove is disposed on an outer surface of the housing and an anchor assembly is axially slidable within the groove.

In certain embodiments, the present disclosure is directed to a method for securing and using hydrajetting tools within a borehole. The method comprises introducing a housing into the borehole, wherein the housing defines an inner bore; axially securing the hydrajetting tool within the borehole using an anchor assembly disposed around the housing, wherein the anchor assembly is engaged with a groove disposed on an outer surface of the housing; and pumping a fluid into a flow limiting member axially secured within the inner bore. The flow limiting member comprises a first jet, a first chamber positioned below and in fluid communication with the first jet, and a first cavity aligned with the first jet and in fluid communication with the chamber.

In certain embodiments, the present disclosure is directed to an apparatus for securing and using hydrajetting tools within a borehole. The apparatus comprises a housing which defines an inner bore and a flow limiting member that is axially secured and disposed within the inner bore. The flow limiting member comprises a first jet in fluid communication with the top of the housing, a first chamber positioned below and in fluid communication with the first jet and a first cavity aligned with the first jet and in fluid communication with the chamber. A groove is disposed on an outer surface of the housing and an anchor assembly is axially slidable within the groove. The anchor assembly comprises an anchor proximate the top of the anchor assembly and a pin disposed on an inner surface of the anchor assembly. The pin is operable to engage with the groove.

The features and advantages of the present invention will be apparent to those skilled in the art from the description of the preferred embodiments which follows when taken in conjunction with the accompanying drawings. While numerous changes may be made by those skilled in the art, such changes are within the spirit of the invention.

FIGURES

Some specific exemplary embodiments of the disclosure may be understood by referring, in part, to the following description and the accompanying drawings.

FIG. 1 shows an example stimulation system, according to aspects of the present disclosure.

Figure 2A:
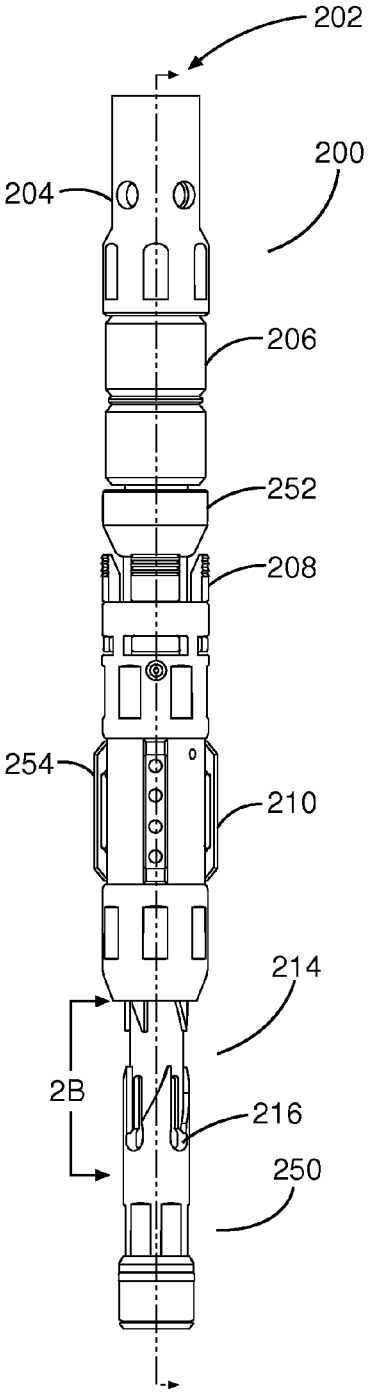
Figure 2B:
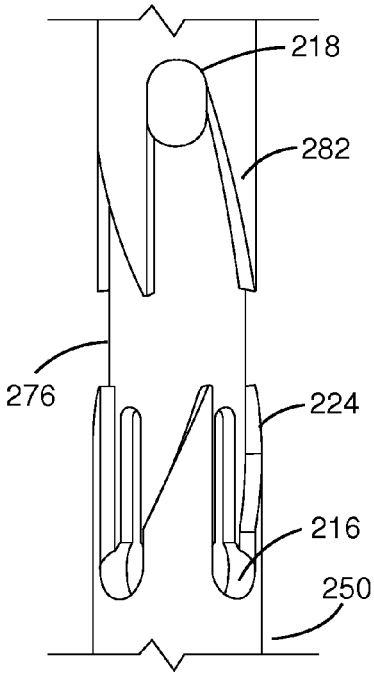
Figure 2C:
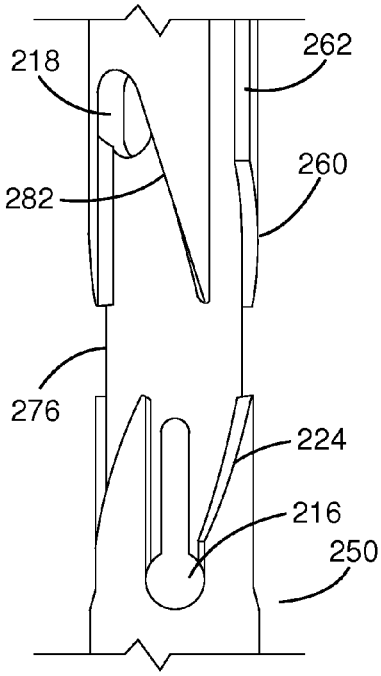

FIGS. 2*a-c* show an example hydrajetting apparatus, according to aspects of the present disclosure.

Figure 3A:
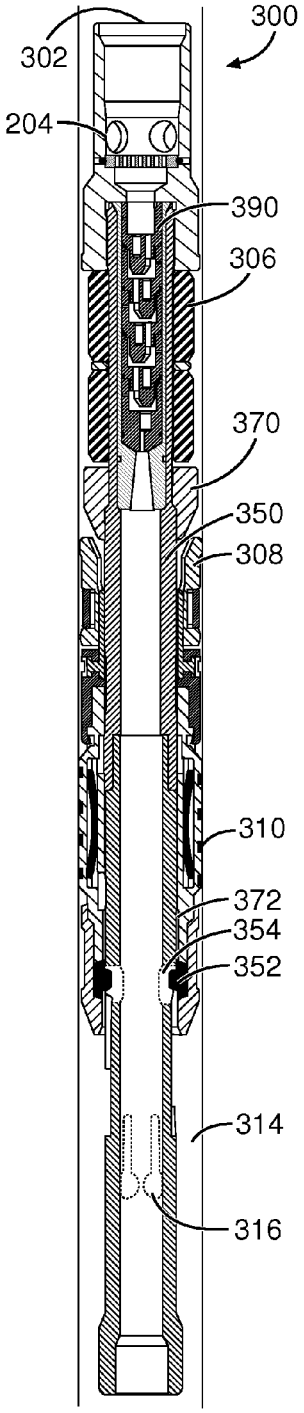
Figure 3B:
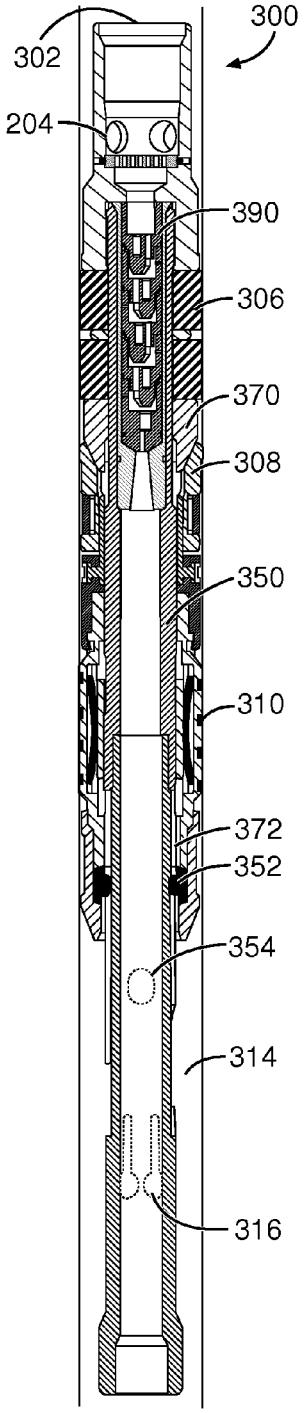
Figure 3C:
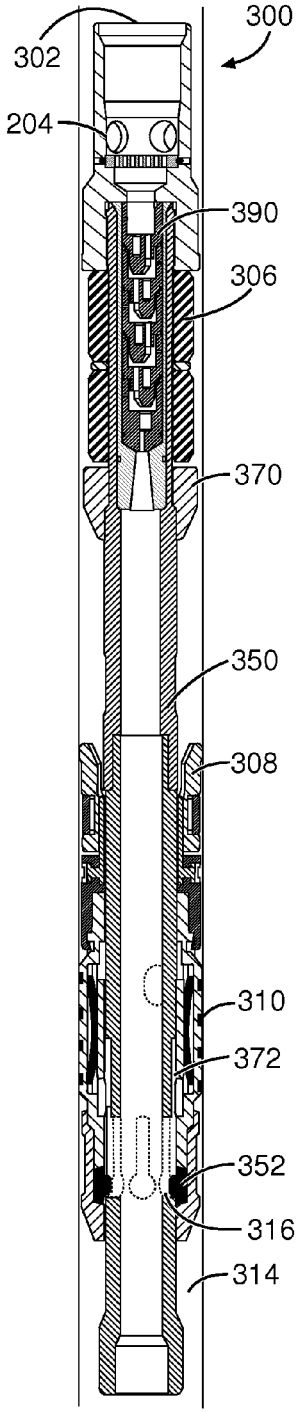

FIGS. 3*a-c* show an example hydrajetting apparatus deployed and secured downhole, according to aspects of the present disclosure.

Figure 4:
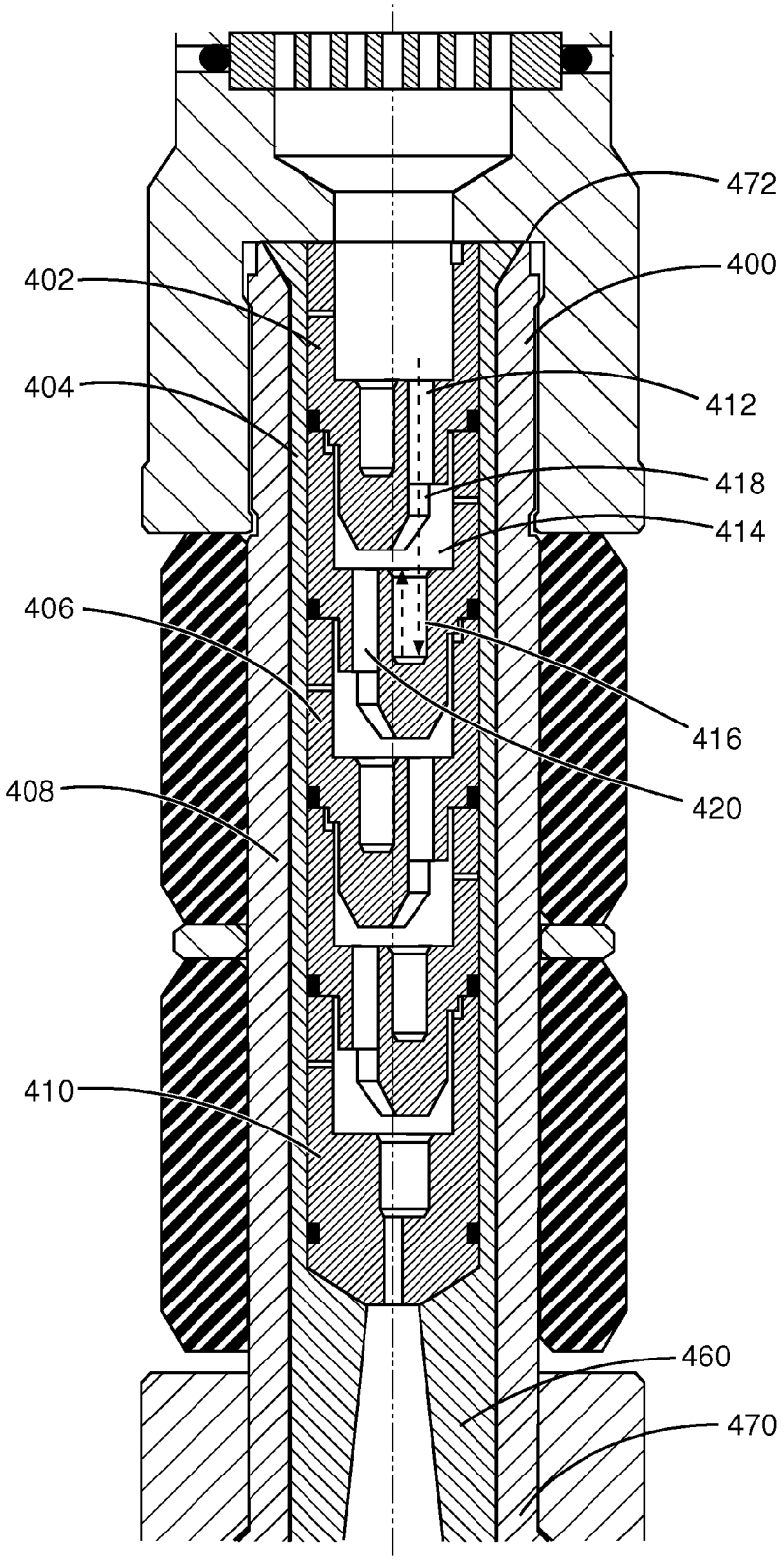

FIG. 4 shows an example flow rate reducer of a hydrajetting apparatus, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to subterranean drilling operations and, more particularly, the present disclosure relates to a method and apparatus for securing and using hydrajetting tools.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

According to aspects of the present disclosure, an apparatus for securing and using hydrajetting tools within a borehole may comprise a housing with an inner bore in fluid communication with surface fluid source. A flow limiting member may be disposed within the inner bore. The flow limiting member may comprise a first jet in fluid communication with the top of the housing, a first chamber positioned below and in fluid communication with the first jet, and a first cavity aligned with the first jet and in fluid communication with the chamber. As will be described below, and as will be appreciated by one of ordinary skill in the art in view of this disclosure, the combinations of jets, chambers, and cavities may create a high pressure, low velocity flow reduction system that is easier to manufacture and maintain than an existing choke, and effectively reduces the flow rate of the fluid traveling through so that a sand plug can be set. The apparatus may also include a groove disposed on an outer surface of the housing, and an anchor disposed around the housing and axially slidable and securable within the groove. The anchor assembly may limit the axial movement of the apparatus when secured within the groove.

FIG. 1 shows an example stimulation system 100. The stimulation system 100 includes a rig 102 mounted at the surface 112, positioned above a borehole 106 within a subterranean formation 120. The rig 102 may be connected via tubing or a coiled tube 108 to a stimulation tool 110. Although a coiled tube 108 is shown, other pipe and connections are possible, as would be appreciated by one of ordinary skill in the art in view of this disclosure. The borehole 106 may comprise a vertical portion 122 and a horizontal portion 116. The horizontal portion 116 may be positioned, for example, within a hydrocarbon formation 118, from which hydrocarbons may be produced. The stimulation tool 110 may be positioned within the borehole 106 either within or adjacent to hydrocarbon formation 118. The stimulation tool 110 may be a hydrajetting tool, and hydrajetting may be accomplished using fluid pumped from the surface through coiled tube 108 and through ports 124. The fluid may cause cracks or fractures 114 within the formation 118, increasing the production of hydrocarbons from the formation 118. After the hydrajetting tool creates fractures 114, it may be desirable to use the hydrajetting at a second location 126 within the formation 118, to further increase hydrocarbon production. In such situations, a sand plug may be set adjacent to fractures 114, preventing the additional stimulation operations from disturbing fractures 114. In certain embodiments, sand or proppants may be sent downhole within the coiled tubing 108, or in the borehole 106, to be set adjacent to the fractures 114. Setting the sand plug in a horizontal borehole may be difficult, however, as it typically requires a flow rate out of the bottom end 128 of the stimulation tool 110 which is significantly less than the flow rate/pressure required to fracture the formation, but existing flow limiting mechanisms, such as chokes, are difficult to control and manufacture, and may become clogged.

Additionally, it may be desirable to position the stimulation tool 110 at a particular location within the borehole, such as where the formation stimulation would achieve the maximum production. Once the stimulation tool 110 is positioned at the location, movement by the tool may reduce the effectiveness of the stimulation, or move the stimulation tool 110 away from the intended position. Anchoring the stimulation tool 110 may be desirable, but setting and unsetting the anchors may be difficult to control, causing the stimulation tool to become stuck within the formation or otherwise difficult to move or retrieve.

According to aspects of the present disclosure, FIG. 2*a* shows an example apparatus 200 for securing and using hydrajetting tools within a borehole. The apparatus 200 may include a housing 250, the bottom portion of which is shown in FIG. 2*a*. The housing 250 may define an inner bore in fluid communication with a surface fluid source, as will be described below with respect to FIGS. 3*a-c*. The apparatus 200 may include a top opening 202 which may be coupled, for example, to coiled tubing, or may be coupled to a hydrajetting tool, and may provide fluid communication between the apparatus 200 and a surface fluid source. The apparatus 200 may include reverse circulation ports 204 proximate the top of the tool, which remain open and allow the pressure above and below the apparatus 200 to equalize. The apparatus 200 may further comprise an extendable support 206 disposed on an outer surface of the housing. The extendable support 206, for example, may be a compressible packer made of an elastomeric material that deforms and extends outward from the housing 250 when engaged by an anchor assembly 210 via the anchor 208 of the anchor assembly 210 and the wedge element 252, as will be described below. The wedge element 252 may compress the extendable support 206 when engaged by the anchor assembly 210.

The anchor assembly 210 may comprise an anchor 208 proximate the top of the anchor assembly 210 and a pin (shown in FIGS. 3*a-c*) disposed on an interior surface of the anchor assembly. The anchor 208 may comprise ridged exterior surfaces which grip the borehole when the anchor assembly 210 is axially secured relative to the housing 250. In certain embodiments, as will be discussed below, the anchor assembly 210 may be forced axially upwards toward the extendable support 206, deforming the extendable support 206, and causing the anchor 208 to be forced outward by the bottom of wedge element 252. Both the extendable support 206 and the anchor 208 may engage with the borehole, maintaining both the axial and rotational position of the apparatus 200.

The anchor assembly 210 may also comprise engagement surfaces 254, which are sized to engage a borehole wall as the apparatus is inserted in the borehole. In particular, the engagement surfaces 254 may engage the borehole wall and force the anchor assembly 210 axially upwards as the apparatus 200 is moved downwards within the borehole; may force the anchor assembly 210 axially downwards as the apparatus is moved upwards within the borehole; and may rotationally secure the anchor assembly 210 as the housing 250 is rotated. As will be appreciated by one of ordinary skill in the art, the anchor assembly 210 may comprise a variety of collars and sleeves which are coupled together and disposed around a housing 250. The anchor assembly 210 may also be an integral piece which includes anchors 208 and engagement surfaces 254.

In certain embodiments, as will be discussed below, the anchor assembly 210 may be axially slidable and securable within at least one groove disposed on an outer surface of the housing. Securing the anchor assembly 210 within a groove may comprise limiting axial movement of the anchor assembly 210 in at least one direction. In certain embodiments, the anchor assembly 210 may comprise a pin (not shown) disposed on an inner surface of the anchor assembly 210 that is operable to engage with the groove and axially secure the anchor assembly. As can be seen in FIGS. 2*b* and *c*, the housing 250 may include a plurality of grooves 216 and 218 disposed on an outer surface, with the plurality of grooves being part of a cam mechanism 276 also disposed on an outer surface of the housing 250.

When the apparatus 200 is being deployed downhole, the anchor assembly 210 may slide axially upwards relative to the housing 250. This may cause the pin to contact and engage the groove 218 and come to rest at the top of the groove 218. In certain embodiments, as can be seen in FIG. 2*a*, and as will be discussed below, the engagement of the pin and the groove 218 may secure the anchor mechanism 210 in an intermediate position, such that anchors 208 do not engage the borehole, and also do not contact wedge element 252. This may allow the apparatus to slide down the borehole without becoming anchored until a pre-determined point.

Once the apparatus 200 has reached the pre-determined position, the apparatus 200 may be set within the borehole by first moving the housing 250 upwards and causing the anchor assembly 210 to move axially downwards relative to the housing 250 and out of top groove 218, towards cam face 278. As the anchor assembly 210 moves downwards, the pin may engage cam face 278 and be directed into bottom groove 280. In certain embodiments, at least one of the grooves may comprise a J-slot. Once in the bottom groove 280, the housing 250 may be moved downwards, causing the anchor mechanism 210 to move axially upwards relative to the housing 250 and the pin to contact cam face 282. As the anchor assembly 210 moves upwards relative to the housing 250, the pin may engage an extended, set groove, which may allow the anchor assembly to travel upwards and engage the wedge element. As will be appreciated by one of ordinary skill in the art in view of this disclosure, this may comprise a locked position, where the anchors 208 and extendable support engage the borehole. In certain embodiments, the cam mechanism 276 may include elongated grooves spaced around the diameter of the housing 250, such that cam face 260 may correspond with cam face 282, and set groove 262 may comprise a groove used to lock the apparatus 200 in place.

To move the apparatus 200 to a different location, the apparatus 200 must be unlocked from the borehole, which may require moving the housing 250 upwards, causing the anchor assembly 210 to move downwards relative to the housing and disengage the wedge element 252. The anchor assembly may move downhole until it contacts a bottom groove. Once the apparatus is positioned at the next pre-determined location, the apparatus may again be placed in a locked position, as described above.

FIGS. 3*a-c* show an example apparatus 300 for securing and using hydrajetting tools within a borehole, with an anchor assembly 310 in three positions relative to housing 350. In particular, FIG. 3*a* shows the apparatus 300 in an intermediate position, as it is being run into borehole 314, with pin 352 of anchor assembly 310 engaged with the top of groove 354 disposed on an outer surface of the housing 350, similar to groove 218 in FIG. 2*b*. As can be seen, the anchor assembly 310 is secured within the groove 354, preventing it from moving axially upwards, with the extendable supports 306 and anchors 308 not engaged. This allows the apparatus 300 to move freely within the borehole 314.

FIG. 3*b* shows apparatus 300 in a locked position within the borehole. As can be seen, housing 350 has been rotated relative to the anchor assembly 310 with the pins 352 being disengaged from groove 354, and engaged with set grooves 372, with the anchor assembly 310 positioned axially higher relative to housing 350. In particular, the anchors 308 may contact the wedge element 370 and force it axially upwards, such that extendable support 306 is deformed to contacts the borehole 314, and anchors 308 are forced outwards to also engage the borehole 314. When the apparatus 300 is in a set position, as is shown in FIG. 3*b*, fluid from the surface may be pumped downhole, and received through opening 302. The opening 302 may provide fluid communication with an inner bore of the housing 350, which may comprise a fluid limiting member 390 disposed therein, as will be discussed below. The fluid limiting member 390 may reduce the flow rate of the fluid in order to set a sand plug.

FIG. 3*c* shows apparatus 300 as it is being moved upwards within the borehole 314. As can be seen, the housing 350 has been rotated relative to the anchor assembly 310, which has unsecured the anchor assembly 310 by disengaging pins 352 from set grooves 372. Once the anchor assembly 310 is unsecured relative to the housing 350, the anchor assembly may move axially relative to the housing 350. As the apparatus 300 is moved upwards, the anchor assembly 310 may slide axially downwards relative to the housing 350, and the pins 352 may contact a bottom surface of groove 316, preventing any further downward axial movement of the anchor assembly 310. Once the apparatus is positioned again, the anchor assembly 310 may again be placed in a locked position by moving the anchor assembly 310 axially upwards relative to housing 350, such that pins 352 engage set groove 372.

FIG. 4 shows an example flow limiting member 400 disposed and axially secured within an inner bore 460 of a housing 470, similar to the housings discussed above. The flow limiting member 400 may comprise a first jet 412 that is in fluid communication with the top of the housing 472. The flow limiting member may further comprise a first chamber 414 positioned below and in fluid communication with the first jet 412. The flow limiting member may also comprise a first cavity 416 aligned with the first jet 412 and in fluid communication with the first chamber 414. As can be seen, fluids entering the top of the housing 472 may be forced to enter jet 412, which may increase the velocity of the fluid due to the narrow diameter. This fluid may be jetted out of the first jet 412 and into the first cavity 416, through first chamber 414, as indicated by arrow 418. As the fluid contacts the bottom of cavity 416, it is reflected back towards jet 412, where it contacts the fluid flow 418, decreasing the kinetic energy and fluid velocity of the flow 418. The fluid flow 418 may collect in the chamber 414, before being passed through jet 420. Notably, given the size of the chamber 414 relative to the fluid jet 412, the fluid flow velocity may be further slowed through collection of the fluid within the chamber 414.

In certain embodiments, the flow limiting member 400 may comprise a plurality of segments 402, 404, 406, 408, and 410. A first segment 402 comprises the first jet 412. A second segment 404 may comprise the first cavity 416. The first chamber 414 may be defined in part by the first segment 402 and the second segment 404. As will be appreciated by one of ordinary skill in the art, each of the segments may be manufactured separately with a similar configuration. The number and configuration of each segment may be selected according to the particular hydrajetting application required. For example, if a high velocity fluid is required for the hydrajetting, additional segments may be added to reduce the flow rate from the flow limiting member 400. Adapting existing hydrajetting apparatuses for different flow rates may require expensive chokes or significant modifications to accommodate the required flow rate reduction. Flow limiting member 400, in contrast, is easily adaptable by including more or less segments, and does not require any mechanically controlled or movable elements, which decrease the reliability of the apparatus.

According to aspects of the present disclosure, a method for securing and using hydrajetting tools within a borehole may be practiced. The method may include introducing a housing into the borehole, with the housing defining an inner bore. The method may further include axially securing the apparatus relative to the borehole using an anchor assembly disposed around the housing, wherein the anchor assembly is engaged with a groove disposed on an outer surface of the housing. The anchor assembly may comprise a pin disposed on an inner surface of the anchor assembly which may engage the groove. In certain embodiments, the groove may be a J-slot. The method may further include pumping a fluid into a flow limiting member disposed and axially secured within the inner bore. The fluid may include a hydrajetting fluid containing sand or proppants. The flow limiting member may comprise a first jet and a first chamber positioned below and in fluid communication with the first jet. The flow limiting member may further comprise a first cavity aligned with the first jet and in fluid communication with the chamber.

Axially securing the anchor assembly within the groove disposed on the outer surface of the housing may comprise axially securing a pin disposed on an interior surface of the anchor assembly within the groove, which may cause an anchor of the anchor assembly to engage the borehole wall. This may be accomplished using a wedge member similar to the wedge member described above. Likewise, axially securing the anchor assembly using the groove disposed on the outer surface of the housing may comprise causing the anchor assembly to deform an extendable support disposed around the housing. The wedge member may, in addition to causing the anchor to engage the borehole, causing the extendable support to contact the borehole wall. When hydrajetting operations are complete at a given location, the method may comprise rotating the housing relative to the anchor assembly, which may axially unsecure the anchor assembly from the housing. Once axially unsecured, the anchor assembly may move axially relative to the housing while, for example, the apparatus is being moved to a different location.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. An apparatus for securing and using hydrajetting tools within a borehole, comprising:
- a housing, wherein the housing defines an inner bore;
- a flow limiting member disposed within the inner bore, wherein the flow limiting member comprises:
  - a first jet in fluid communication with the top of the housing,
  - a first chamber positioned below and in fluid communication with the first jet, and
  - a first cavity aligned with the first jet and in fluid communication with the chamber;
- a groove disposed on an outer surface of the housing; and
- an anchor assembly axially slidable within the groove,
- wherein the flow limiting member comprises a plurality of segments;
- a first segment of the plurality of segments comprises the first jet;
- a second segment of the plurality of segments comprises the first cavity; and
- the first chamber is defined in part by the first segment and the second segment.

2. The apparatus of claim 1, wherein flow limiting member is axially secured within the inner bore.

3. The apparatus of claim 1, wherein the groove comprises a J-slot.

4. The apparatus of claim 1, further comprising an extendable support disposed on an outer surface of the housing.

5. The apparatus of claim 4, wherein the anchor assembly is operable to engage the extendable support.

6. The apparatus of claim 5, wherein extendable support comprises a compressible packer.

7. The apparatus of claim 1, wherein the anchor assembly is operable to:
- engage with the borehole when the anchor assembly is engaged with the groove, and
- disengage from the borehole when the housing is pulled axially upwards and rotated.

8. A method for securing and using hydrajetting tools within a borehole, comprising:
- introducing a housing into the borehole, wherein the housing defines an inner bore;
- axially securing the hydrajetting tool within the borehole using an anchor assembly disposed around the housing, wherein the anchor assembly is engaged with a groove disposed on an outer surface of the housing; and
- pumping a fluid into a flow limiting member axially secured within the inner bore, wherein the flow limiting member comprises:
  - a first jet,
  - a first chamber positioned below and in fluid communication with the first jet, and
  - a first cavity aligned with the first jet and in fluid communication with the chamber,
- wherein the flow limiting member comprises a plurality of segments;
- a first segment of the plurality of segments comprises the first jet;
- a second segment of the plurality of segments comprises the first cavity; and
- the first chamber is defined in part by the first segment and the second segment.

9. The method of claim 8, wherein axially securing the hydrajetting tool within the borehole using an anchor assembly disposed around the housing comprises causing a pin disposed on an interior surface of the anchor assembly to engage with the groove.

10. The method of claim 8, wherein the groove comprises a J-slot.

11. The method of claim 8, wherein axially securing the hydrajetting tool within the borehole using an anchor assembly disposed around the housing comprises causing the anchor assembly to deform an extendable support disposed around the housing.

12. The method of claim 11, wherein deforming the extendable support causes the extendable support to contact the borehole wall.

13. The method of claim 8, further comprising rotating the housing relative to the anchor assembly, wherein rotating the housing relative to the anchor assembly axially unsecures the anchor assembly.

14. The method of claim 13, further comprising moving the anchor assembly axially relative to the housing.

15. An apparatus for securing and using hydrajetting tools within a borehole, comprising:
- a housing, wherein the housing defines an inner bore;
- a flow limiting member axially secured and disposed within the inner bore, wherein the flow limiting member comprises:
  - a first jet in fluid communication with the top of the housing, a first chamber positioned below and in fluid communication with the first jet, and a first cavity aligned with the first jet and in fluid communication with the chamber;

a groove disposed on an outer surface of the housing; and an anchor assembly axially slidable within the groove, wherein the anchor assembly comprises an anchor proximate the top of the anchor assembly and a pin disposed on an inner surface of the anchor assembly, wherein the pin is operable to engage with the groove, wherein the flow limiting member comprises a plurality of segments;

a first segment of the plurality of segments comprises the first jet;

a second segment of the plurality of segments comprises the first cavity; and the first chamber is defined in part by the first segment and the second segment.

16. The apparatus of claim 15, wherein the groove comprises a J-slot.

17. The apparatus of claim 15, wherein the anchor is operable to engage with the borehole when the pin is engaged with the groove, and disengage from the borehole when the housing is rotated and pulled axially upwards.

* * * * *